US006288736B1

(12) United States Patent
Inoue

(10) Patent No.: US 6,288,736 B1
(45) Date of Patent: Sep. 11, 2001

(54) THERMAL TRANSFER RECORDING METHOD

(75) Inventor: Yasutoshi Inoue, Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/306,680

(22) Filed: May 6, 1999

(30) Foreign Application Priority Data

May 14, 1998 (JP) ..... 10-131918

(51) Int. Cl.[7] ..... B41J 2/325
(52) U.S. Cl. ..... 347/212; 347/171
(58) Field of Search ..... 347/212, 171; 400/120.01, 120.8

(56) References Cited

U.S. PATENT DOCUMENTS 4,704,615 11/1987 Tanaka .
5,546,114 * 8/1996 Tait et al. ..... 347/212
5,552,819 * 9/1996 Brandt et al. ..... 347/212
5,589,869 12/1996 Brandt et al. .
5,982,405 * 11/1999 Sasaki et al. ..... 347/212

FOREIGN PATENT DOCUMENTS 57 020389 2/1982 (JP) .
57 105386 6/1982 (JP) .
60 260363 12/1985 (JP) .
07 052593 2/1995 (JP) .
09 201989 8/1997 (JP) .
09 277677 10/1997 (JP) .

* cited by examiner

*Primary Examiner*—Huan Tran
(74) *Attorney, Agent, or Firm*—Brinks Hofer Gilson & Lione

(57) ABSTRACT

A heat-fusible ink is fused and transferred to opaque recording paper on the basis of recording information to make an underlying layer and a metallic-luster ink is transferred to the underlying layer to make a record. Even if the metallic-luster ink is used, a beautiful record can be stably made on the various kinds of recording papers.

2 Claims, 2 Drawing Sheets

THERMAL TRANSFER RECORDING METHOD

BACKGROUND OF THE INVENTION

1. Field of the Invention

The present invention relates to a thermal transfer recording method, and in particular, to a thermal transfer recording method for making a record with the use of a metallic ink.

2. Description of the Related Art

In general, a thermal transfer recording device has been widely used as an output device of a computer, a word processor and the like because it is of high recording quality, low noise, low cost, and easy maintenance.

In the general thermal transfer recording device like this, recording paper is held in front of a platen and a thermal head having a plurality of heating elements is mounted on a carriage. While the thermal head is being reciprocated along the platen with the carriage in the state in which an ink ribbon and the recording paper are sandwiched between the thermal head and the platen, the ink ribbon is unreeled and a current is passed selectively through the heating elements of the thermal head on the basis of recording information to heat the heating elements selectively, whereby the ink of the ink ribbon is partially transferred to the recording paper to record a desired picture such as a character on the recording paper In the conventional thermal transfer recording device like this, a recording device has been well known which uses a heat-fusible ink ribbon made of base material like a plastic film to which heat-fusible ink is applied. When this heat-fusible ink ribbon is used for making a record, it can make a record on the various kinds of recording papers such as smooth paper, ordinary paper, thick paper, and a post card, and has excellent usability.

Further, in recent years, a lustrous record has been made by transferring a metallic-luster ink such as gold ink and silver ink. When the metallic-luster ink is transferred, to keep the lustrous surface of the ink, the fused and transferred ink is cooled and solidified and then it is separated to make a record.

That is, in the case where a record is made with the use of the metallic-luster ink in the conventional thermal transfer recording device described above, it is necessary that the metallic-luster ink is separated after it is cooled and solidified. In the case where the metallic-luster ink is separated after it is cooled and solidified, since wax-based or semi-resin-based material is used as an adhesive for bonding an ink layer to the basematerial of the ink ribbon, a relatively good record can be made for the recording paper having a smooth surface like smooth paper. However, there exist a problem that if the metallic-luster ink is transferred to the recording paper having a rough surface like rough paper, the ink is separated or is not suitably transferred. Therefore, there exists a problem that when a record is made with the use of the metallic-luster ink, a beautiful record can not be made stably on the various kinds of recording papers other than the smooth paper.

Further, even if the smooth paper is used, when characters smaller than a twenty-odd point are recorded, there exists another problem that the characters become so faint that they can not be recorded correctly.

SUMMARY OF THE INVENTION

It is the object of the present invention to provide a thermal transfer recording method for making a beautiful record stably on the various kinds of opaque recording papers even in the case where a metallic-luster ink is used.

That is, a thermal transfer recording method according to the present invention is the method in which a metallic-luster ink is transferred to opaque recording paper to make a record by moving a thermal head on the basis of predetermined recording information, and is characterized in that a heat-fusible ink is fused and transferred to the recording paper on the basis of the recording information to make an underlying layer and that the metallic-luster ink is transferred to the underlying layer to make a record.

It is the object of the present invention to eliminate variations in the transfer of the metallic-luster ink by transferring the metallic-luster ink to a recording area after the recording area is made smooth by the underlying layer and to stably transfer the metallic-luster ink even to the recording papers having variations in surface roughness from smooth paper to rough paper. Further, it is another object of the present invention to reduce running costs by forming the underlying layer with an ordinary heat-fusible ink in comparison with the case where the underlying layer is formed with ink designed specially therefor.

Further, the thermal transfer recording method according to the present invention is characterized in that the underlying layer is made slightly larger than an area to be recorded with the metallic-luster ink.

It is the object of the present invention to increase the visibility of a picture recorded with the metallic-luster ink and to make even small characters clearly visible by edging the picture recorded with the metallic-luster ink with the underlying layer by adopting the constitution like this.

Further, the thermal transfer recording method according to the present invention is characterized in that the underlying layer is made with a black ink.

It is the object of the present invention to decrease the generation of voids of the recording paper, in particular, having a rough surface like the rough paper and to increase a feeling of luster of the metallic-luster ink by adopting the constitution like this.

Further, the thermal transfer recording method according to the present invention is characterized in that a plurality of underlying layers are overlaid.

It is the object of the present invention to make the underlying layer thick and to record a cubic picture with the metallic-luster ink by adopting the constitution like this.

Further, the thermal transfer recording method according to the present invention is characterized in that a picture is formed on all the area of the underlying layer on the basis of the picture information and that the picture is covered with the metallic-luster ink.

It is the object of the present invention to relieve the a picture portion formed on the basis of the recording information and to represent an uneven picture like a relief on the metallic-luster ink surface by adopting the constitution like this.

DETAILED DESCRIPTION OF THE PREFERRED EMBODIMENTS

The preferred embodiment of the present invention will be hereinafter described with reference to FIG. 1 and FIG. 2.

Figure 1:
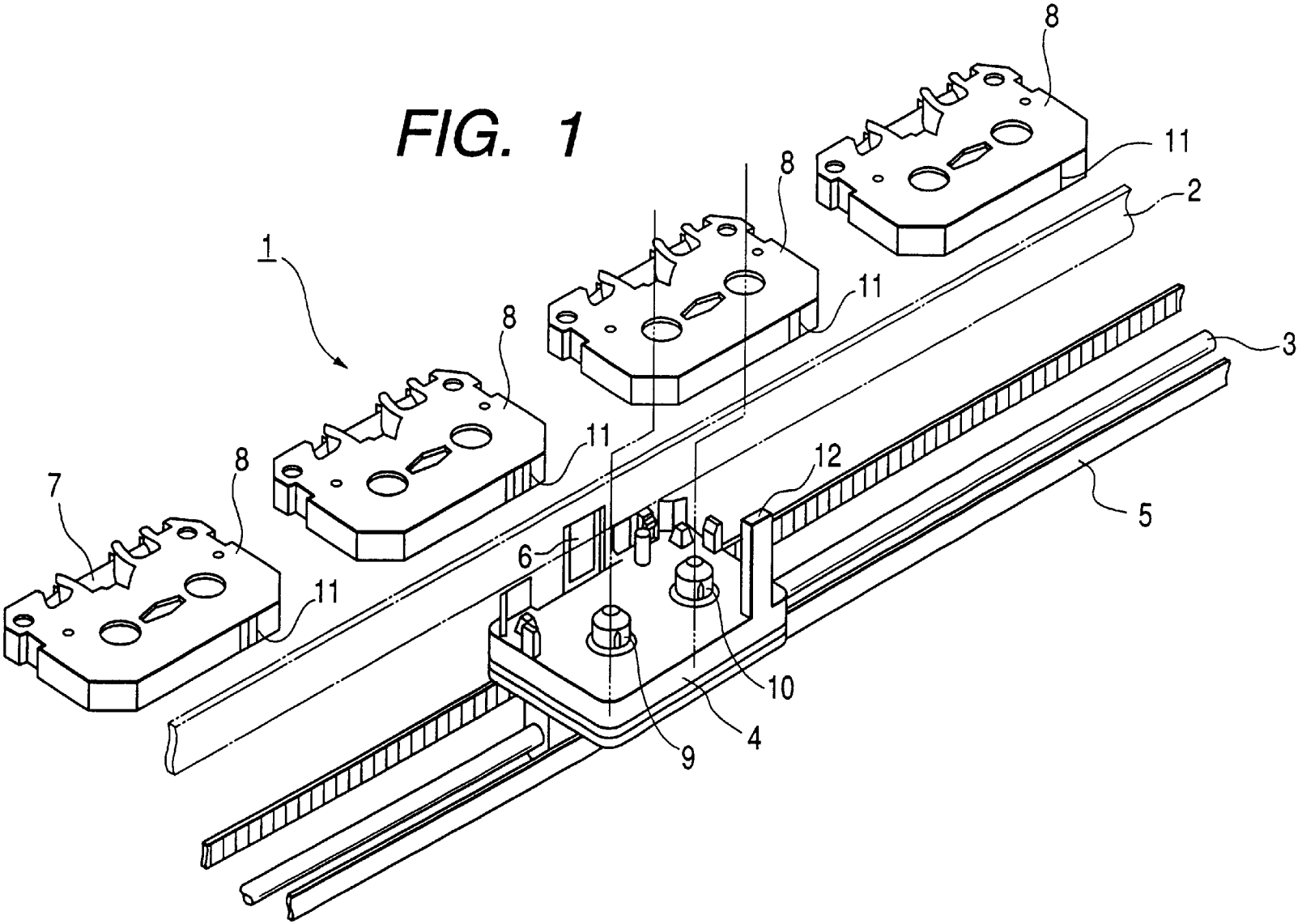
FIG. 1 is a schematic perspective view showing one preferred embodiment of a thermal transfer recording device for applying a thermal transfer recording method according to the present invention.

FIG. 1 is one preferred embodiment of a thermal transfer recording device for applying the thermal transfer recording method according to the present invention. A plate-shaped platen 2 is arranged on the frame (not shown) of the thermal transfer recording device 1 such that the recording surface thereof is nearly vertical. A guide shaft 3 is arranged in parallel to the platen 2 in front of and below the platen 2. A carriage 4 divided into the upper and lower parts is provided on the guide shaft 3 such that it can be reciprocated along the shaft 3 and a drive belt 5 looped around a pair of pulleys (not shown) is connected to the carriage 4. And the drive belt 5 is driven by drive means (not shown) such as a stepping motor via the pulley, thereby reciprocating the carriage 4 along the guide shaft 3.

Further, the carriage 4 is provided with a thermal head 6 which is opposed to the platen 2 and can be brought into contact with or separated from the platen 2, and the thermal head 6 is provided with a plurality of heating elements (not shown) which are arranged in a line and selectively heated on the basis of desired recording information. A ribbon cassette 8 in which an ink ribbon 7 is received is removably mounted on the top surface of the carriage 4. A reeling bobbin 9 for reeling the ink ribbon 7 of the ribbon cassette 8 and a feeding bobbin 10 for feeding it are rotatably arranged on the top surface of the carriage 4.

Further, a plurality of ribbon cassettes 8 are held above the carriage 4 by a cassette holder (not shown). The upper part of the carriage 4 divided in the upper part and the lower part is moved up and down by a mechanism (not shown), whereby each ribbon cassette 8 can be selectively passed between the cassette holder and the carriage 4.

An identification mark 11 for identifying the kind of the ink ribbon 7 received in each ribbon cassette 8 is formed on the back surface of each ribbon cassette 8. Further, an optical sensor 12 for detecting the identification mark 11 formed on the ribbon cassette 8 is arranged on the end of the remote side with respect to the platen 2 of the carriage 4.

Figure 2:
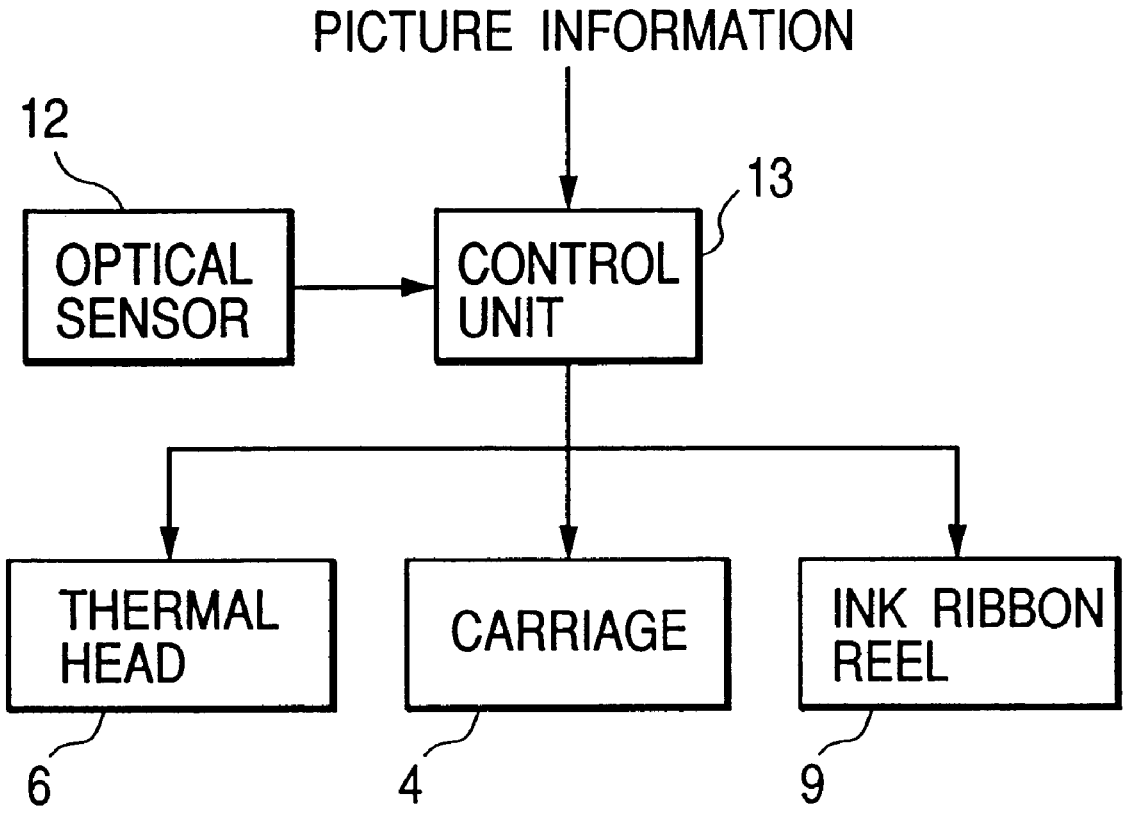
FIG. 2 is a block diagram showing a control circuit of the thermal transfer recording device shown in FIG. 1.

Further, as shown in FIG. 2, in the present preferred embodiment, a control unit 13 is arranged to which picture information from a host computer or a picture reader (both not shown) and the detection signal from the optical sensor 12 are input. The control unit 13 drives and controls the thermal head 6 and the carriage 4 and reels the ink ribbon 7 according to the picture information, and selects the desired ribbon cassette 8 according to the detection signal of the optical sensor 12.

Next, a thermal transfer recording method using the thermal transfer recording device constituted as described above.

First, at least the ribbon cassette 8 in which a heat-fusible opaque black ink ribbon 7 is received and the ribbon cassette 8 in which a metallic-luster ink ribbon 7 is received are mounted in the cassette holders, respectively.

Then, in the present preferred embodiment, when the picture information is input to the control unit 13, a record is made with the use of the black ink on the basis of the picture information to make an underlying layer. That is, while the carriage 4 is being moved by the control unit 13, the identification mark 11 of the ribbon cassette 8 is detected by the optical sensor 12. When the identification mark 11 of the black ribbon cassette 8 is detected by the optical sensor 12, the carriage 4 is stopped and the black ribbon cassette 8 held by the cassette holder is passed to the carriage 4. Then, the thermal head 6 is moved by the control unit 13 on the basis of the picture information while the carriage 4 is being moved in the state in which the thermal head 6 is brought into contact with the platen 2 via the ink ribbon 7 and the recording paper, whereby the black ink is heated, fused, and transferred to the recording paper to make the underlying layer. In this case, in the present preferred embodiment, the underlying layer is recorded in such a way that the contour thereof is a little larger than the picture information.

After a record is made with the opaque black ink ribbon 7, a record with the metallic-luster ink ribbon is overlaid thereon. That is, the carriage 4 is moved to the position opposite to the cassette holder in which the black ribbon cassette 8 has been held and passes the black ribbon cassette 8 to the cassette holder and then the identification mark 11 of the metallic-luster ink ribbon cassette 8 is detected by the optical sensor 12 and the metallic ribbon cassette 8 is passed to the carriage 4 just as in the case of the abovementioned action.

The thermal head 6 is moved by the control unit 13 on the basis of the picture information while the carriage 4 is being moved in the state in which the thermal head 6 is brought into contact with the platen 2 via the ink ribbon 7 and the recording paper, whereby a record is made with the metallic-luster ink on the underlying layer made with the black ink. In this case, in the present preferred embodiment, the record with the metallic-luster ink is made when the metallic-luster ink is separated after it is cooled and solidified.

In this manner, in the present preferred embodiment, when the record is made with the metallic-luster ink, the underlying layer is made with the black ink. Since the heat-fusible black ink can make the record on the various kinds of opaque recording papers from the smooth paper to the rough paper, the underlying layer can be made suitably with the black ink. Further, since the portion recorded with the metallic-luster ink can be made smooth by making the underlying layer, when the record is made with the metallic-luster ink, the metallic-luster ink can be surely prevented from being separated and can be transferred stably. And the voids of the recording paper having a rough surface such as the rough paper can be decreased to increase a feeling of luster of the metallic-luster ink.

Further, when the underlying layer described above is made, a plurality of underlying layers may be overlaid on a position corresponding to a picture to be recorded. When a picture is recorded on the underlying layer with the metallic-luster ink, the picture can be made cubic because the underlying layer is made thick. In this case, the underlying layer may be made thick by making one underlying layer with the use of the ink ribbon having a thick ink layer.

Further, it is also recommended that, after the underlying layer is made on all the area where a picture is to be formed, a desired picture be recorded on the underlying layer on the basis of the picture information with the use of the same ink as the underlying layer and then a record be made on the recorded picture with the metallic-luster ink. This can relieve the picture portion of the underlying layer made previously to represent the picture by projections and depressions like a relief.

Therefore, in the present preferred embodiment, if the metallic-luster ink is used for the various kinds of opaque recording papers from the smooth paper to the rough paper, it is surely possible to prevent the ink from being separated and to make a beautiful record stably. Further, since the underlying layer is recorded in such a way that the contour thereof is slightly larger than the picture information in the present preferred embodiment, the underlying layer extends off the peripheral edge of the picture recorded with the metallic-luster ink, that is, the picture recorded with the metallic-luster ink is edged with the underlying layer. This can remarkably increase the visibility of the picture recorded with the metallic-luster ink and hence make small characters clearly visible. Further, since the underlying layer is made with the heat-fusible ink, running costs can be decreased and a recording speed can be increased in comparison with the case where ink designed specially for the underlying layer is used.

In this connection, although the underlying layer is made with the black ink in the preferred embodiment described above, the other color of ink may be used for making the underlying layer.

Further, it is not intended to limit the present invention to the preferred embodiment described above, but the present invention can be modified if necessary.

As described above, in the thermal transfer recording method, when the metallic-luster ink is transferred to make a record, the heat-fusible ink is fused and transferred to the recording paper to make the underlying layer. Therefore, the underlying layer can be made suitably and when a record is made with the metallic-luster ink, the record can be made stably for the various kinds of opaque recording papers from the smooth paper to the rough paper. Further, since the underlying layer is made with the heat-fusible ink, the running costs can be decreased and the recording speed can be increased in comparison with the case where the ink designed specially for the underlying layer is used.

Further, since the underlying layer is made slightly larger than the area to be recorded with the metallic-luster ink, the picture recorded with the metallic-luster ink is edged with the underlying layer. This can remarkably increase the visibility of the picture recorded with the metallic-luster ink and hence make the small characters clearly visible.

Further, since the black ink is used for making the underlying layer, it can decrease the voids of the recording paper, in particular, having a rough surface like the rough paper, and hence can increase a feeling of luster of the metallic-luster ink.

Furthermore, since the plurality of underlying layers are overlaid on a position corresponding to a picture to be recorded to make the underlying layer thick, when a picture is recorded on the thick underlying layer with the metallic-luster ink, the picture can be made cubic.

Furthermore, the underlying layer is made on all the area where the picture is to be formed and then a desired picture is recorded thereon on the basis of the picture information. Therefore, when a picture is recorded on the picture on the underlying layer with the use of the metallic-luster ink, the picture portion of the underlying layer made previously can be relieved, which can produce an effect that the picture can be represented by the projections and depressions like a relief.

What is claimed is:

1. A thermal transfer recording method for printing a desired image with metallic-luster ink, the method comprising the steps of:

a) printing an underlying layer on a surface of opaque recording paper, said underlying layer being printed by depositing a heat-fusible ink over an area that underlies, and is larger than, an area of the desired image;

b) printing an underlying image of the desired image, said underlying image being printed by depositing the heat-fusible ink on top of the underlying layer, said underlying image being printed only over the area of the desired image; and c) printing the desired image with metallic-luster ink, the desired image being printed by depositing the metallic-luster ink on top of the underlying image.

2. A thermal transfer recording method according to claim 1, wherein the heat-fusible ink used to print the underlying layer and the underlying image is a black ink.

* * * * *